US008438869B2

(12) United States Patent
Kim et al.

(10) Patent No.: US 8,438,869 B2
(45) Date of Patent: May 14, 2013

(54) REFRIGERATOR WITH ICE MAKING ROOM

(75) Inventors: Dongjeong Kim, Seoul (KR); Wookyong Lee, Seoul (KR); Changho Seo, Seoul (KR)

(73) Assignee: LG Electronics Inc., Seoul (KR)

( * ) Notice: Subject to any disclaimer, the term of this patent is extended or adjusted under 35 U.S.C. 154(b) by 274 days.

(21) Appl. No.: 12/917,509

(22) Filed: Nov. 2, 2010

(65) Prior Publication Data

US 2011/0100047 A1 May 5, 2011

(30) Foreign Application Priority Data

Nov. 3, 2009 (KR) ..... 10-2009-0105625

(51) Int. Cl.
*F25C 1/22* (2006.01)
*F25D 25/00* (2006.01)
*F25D 3/02* (2006.01)

(52) U.S. Cl.
USPC ..... 62/340; 62/377; 62/420; 62/425

(58) Field of Classification Search ..... 62/377, 62/420, 425
See application file for complete search history.

(56) References Cited

U.S. PATENT DOCUMENTS

| | | | | |
|---|---|---|---|---|
| 7,240,510 | B2 | 7/2007 | Lee et al. | |
| 7,240,511 | B2 | 7/2007 | Lee et al. | |
| 2005/0132535 | A1 * | 6/2005 | Jang et al. | 16/357 |
| 2005/0160756 | A1 | 7/2005 | Lee et al. | |
| 2005/0183441 | A1 | 8/2005 | Lee et al. | |
| 2007/0119204 | A1 | 5/2007 | Kwon | |
| 2008/0307823 | A1 | 12/2008 | Lee et al. | |
| 2010/0101200 | A1 | 4/2010 | Pierson | |
| 2010/0101257 | A1 | 4/2010 | Lee et al. | |
| 2010/0101258 | A1 | 4/2010 | Lee et al. | |
| 2010/0101259 | A1 | 4/2010 | Lee et al. | |
| 2010/0101263 | A1 | 4/2010 | Lee et al. | |

FOREIGN PATENT DOCUMENTS

| | | | |
|---|---|---|---|
| JP | 2005-214620 A | | 8/2005 |
| JP | 2005-214621 A | | 8/2005 |
| KR | 10-0614315 B1 | | 8/2006 |
| KR | WO 2006/083111 | * | 8/2006 |

OTHER PUBLICATIONS

PCT International Search Report and Written Opinion dated Jul. 21, 2011 for Application No. PCT/KR2010/007439, 11 pages.

* cited by examiner

*Primary Examiner* — Judy Swann
*Assistant Examiner* — Christopher R Zerphey
(74) *Attorney, Agent, or Firm* — Fish & Richardson P.C.

(57) ABSTRACT

Disclosed herein is a refrigerator having an ice-making chamber, and the refrigerator may include a refrigerator body and an ice-making chamber, and the ice-making chamber may include an ice-making chamber body one side of which is opened, a connecting duct provided in a first sidewall of the ice-making chamber to be connected to the refrigerator body, an ice-making chamber door provided at a second sidewall of the ice-making chamber to open and close the ice-making chamber, and a protrusion portion formed to be protruded at the first sidewall. Accordingly, the thickness of the ice-making chamber door can be secured without changing a cool air channel of the ice-making chamber, thereby increasing a cooling chamber.

14 Claims, 9 Drawing Sheets

REFRIGERATOR WITH ICE MAKING ROOM

CROSS-REFERENCE TO RELATED APPLICATIONS

The present disclosure relates to subject matter contained in priority Korean Application No. 10-2009-0105625 filed on Nov. 3, 2009, which is herein expressly incorporated by reference in its entirety.

BACKGROUND OF THE INVENTION

1. Field of the Invention

The present disclosure relates to a refrigerator having an ice-making chamber, and more particularly, to a refrigerator having an ice-making chamber in which the space of the cooling chamber in the refrigerator is increased without changing a cool air channel of the ice-making chamber.

2. Description of the Related Art

As is generally known, a refrigerator is a device for refrigerating or freezing foods to keep them fresh. The refrigerator may include a refrigerating chamber and a freezing chamber, and may be classified into so-called a top freezer, a bottom freezer, and a side-by-side refrigerator according to the type of arrangement.

FIG. 1 is a perspective view illustrating a refrigerator in the related art, and FIG. 2 is a perspective view illustrating a state of an ice-making chamber door being opened.

As illustrated in FIGS. 1 and 2, the refrigerator may include a refrigerator body 10 having a refrigerating chamber 20 and a freezing chamber 30, and a refrigerating chamber door 25 and a freezing chamber door 35 for opening and closing the refrigerating chamber 20 and freezing chamber 30.

It may be configured with a plurality of refrigerating chamber doors 25. The refrigerating chamber doors 25 may be revolvably combined with the refrigerator body 10, respectively.

The freezing chamber door 35 may be configured to be slid back and forth.

The refrigerating chamber door 25 may be provided with a dispenser 27 to take out water or ice without opening the refrigerating chamber 20.

An ice-making chamber 50 may be provided in the refrigerating chamber door 25 to make ice. An ice-making chamber door 55 may be provided at the ice-making chamber 50 to open and close the ice-making chamber 50. An ice maker 60 may be provided inside the ice-making chamber 50 to make ice. An ice bank 65 may be provided inside the ice-making chamber 50 to accommodate and store the ice that has been made in the ice maker 60.

On the other hand, a sidewall cool air duct 28 may be provided in the refrigerator body 10 to provide cool air to the ice-making chamber 50. It may be configured with a plurality of sidewall cool air ducts 28. One of the sidewall cool air ducts 28 may be a cool air supply channel for providing cool air that has been produced in the freezing chamber 30 to the ice-making chamber 50, and the other one may be a cool air return channel for returning the cool air that has passed through the ice-making chamber 50 to the freezing chamber 30.

A connecting duct 53 may be provided at a sidewall of the ice-making chamber 50 to be connected to the sidewall cool air duct 28.

However, according to such a refrigerator in the related art, a region of the ice-making chamber 50 is inserted into the refrigerating chamber 20, and thus when the width of the ice-making chamber 50 is large, the space of the refrigerating chamber 20 in the refrigerator may be reduced to that extent.

Furthermore, a hinge-combining region of the ice-making chamber door 55 is thin in thickness, thereby reducing the insulation performance. Moreover, when foaming solution is filled therein, the foaming solution may not be sufficiently flowed therein.

Furthermore, the connecting duct 53 is provided inside a sidewall of the ice-making chamber 50, and thus the structure of a cool air channel, more specifically, the structure of both the connecting duct 53 and sidewall cool air duct 28 should be changed to increase or decrease the width of the ice-making chamber 50.

In order to increase the thickness of the refrigerating chamber door 55 without changing the structure of the cool air channel, an outer side of the refrigerating chamber door 55, more specifically, a thickness of the refrigerating chamber door 55 should be increased to a side of the refrigerating chamber 20. Accordingly, the (storage) space of the refrigerating chamber 20 may be reduced as much as increasing the thickness of the refrigerating chamber door 55 is increased.

SUMMARY OF THE INVENTION

In order to solve the foregoing problem, one aspect of the detailed description is to provide a refrigerator having an ice-making chamber in which the protrusion width (thickness) of the ice-making chamber can be reduced.

Furthermore, another aspect of the detailed description is to provide a refrigerator having an ice-making chamber in which the thickness of an ice-making chamber door can be secured without changing a cool air channel of the ice-making chamber.

In addition, still another aspect of the detailed description is to provide a refrigerator having an ice-making chamber in which the thickness of an ice-making chamber door can be secured without changing a cool air channel of the ice-making chamber, thereby increasing the cooling chamber (storage space).

In order to accomplish the foregoing objectives of the present invention, there is provided a refrigerator having an ice-making chamber, including a refrigerator body formed with a cooling chamber; a door configured to open and close the cooling chamber; and an ice-making chamber formed in the door, wherein the ice-making chamber may include an ice-making chamber body, one side of which is opened; a connecting duct provided in a first sidewall of the ice-making chamber to be connected to the refrigerator body; an ice-making chamber door provided at a second sidewall of the ice-making chamber to open and close the ice-making chamber; and a protrusion portion formed to be protruded at the first sidewall.

Here, a region of the connecting duct may be disposed inside the protrusion portion.

The connecting duct may be disposed to be inclined with respect to a width direction of the ice-making chamber door.

An ice-making chamber door pocket may be provided at the ice-making chamber door.

The ice-making chamber door may be provided with an insulating material.

The insulating material may be formed by filling foaming solution between an outer plate and an inner plate of the ice-making chamber door.

A plurality of protrusion portions may be provided therein, and vertically disposed to be separated from one another.

An ice-making chamber door fixing portion may be provided between the protrusion portions to maintain a state of the ice-making chamber door being closed.

The protrusion portion may be formed with a single body having a long length in a vertical direction.

The ice-making chamber door may be formed to be disposed at a side of the protrusion portion.

An end of the protrusion portion may be disposed on the same plane as an outer surface of the ice-making chamber door.

The protrusion portion may form a step from an outer surface of the ice-making chamber door.

The ice-making chamber door may be provided with a cover portion extended to be disposed at an outer side of the protrusion portion.

On the other hand, according to another aspect of the present invention, there is provided a refrigerator having an ice-making chamber, including a refrigerator body provided with a refrigerating chamber; a refrigerating chamber door configured to open and close the refrigerating chamber; and an ice-making chamber formed at the refrigerating chamber door, wherein the ice-making chamber may be provided with a first sidewall and a second sidewall disposed in parallel to each other, and a protrusion portion more protruded than the second sidewall is formed at the first sidewall, and the ice-making chamber may include an ice-making chamber door provided at the second sidewall to open and close the ice-making chamber; and a connecting duct disposed inside the first sidewall to be connected to the refrigerator body.

Here, a freezing chamber may be provided at a lower side of the refrigerating chamber, and a sidewall cool air duct may be provided in the refrigerator body such that one end thereof is communicated with the freezing chamber, and the other end thereof is connected to the connecting duct.

In addition, according to still another aspect of the present invention, there is provided a refrigerator having an ice-making chamber, including a refrigerator body provided with a refrigerating chamber at an upper portion thereof and a freezing chamber at a lower portion thereof, and provided with a sidewall cool air duct communicated with the freezing chamber at a sidewall thereof; a refrigerating chamber door configured to open and close the refrigerating chamber; and an ice-making chamber provided in the refrigerating chamber door, wherein the ice-making chamber may include an ice-making chamber body one side of which is opened; a connecting duct provided in a first sidewall of the ice-making chamber to be connected to the sidewall cool air duct; an ice-making chamber door provided at a second sidewall of the ice-making chamber to open and close the ice-making chamber; and a protrusion portion formed to be more protruded at the first sidewall than the second sidewall.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Hereinafter, the present invention will be described in detail with reference to the accompanying drawings.

Figure 1:
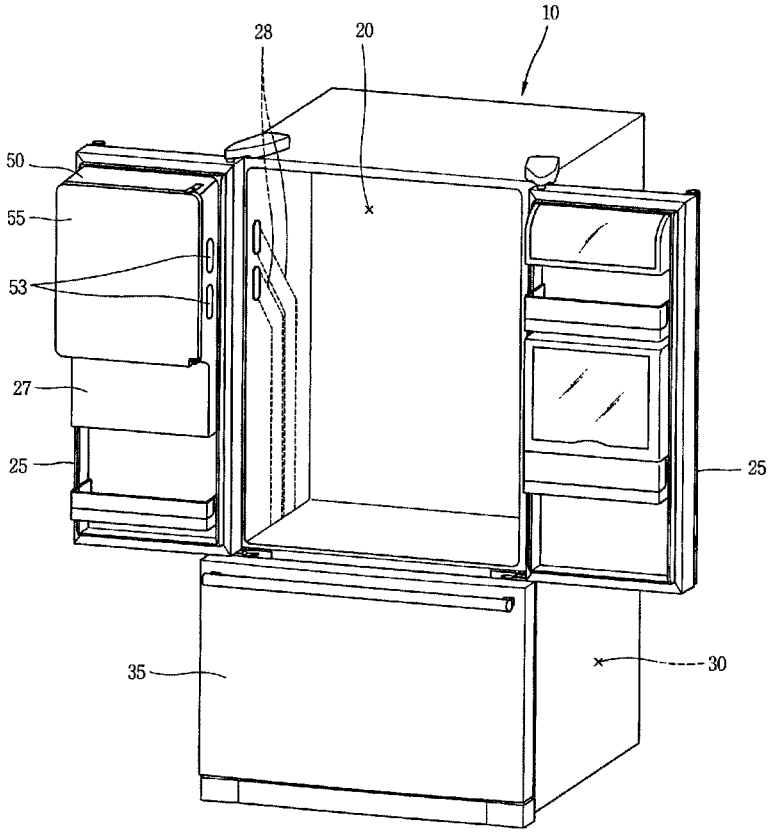
FIG. 1 RELATED ART
FIG. 1 is a perspective view illustrating a refrigerator in the related art.
Figure 2:
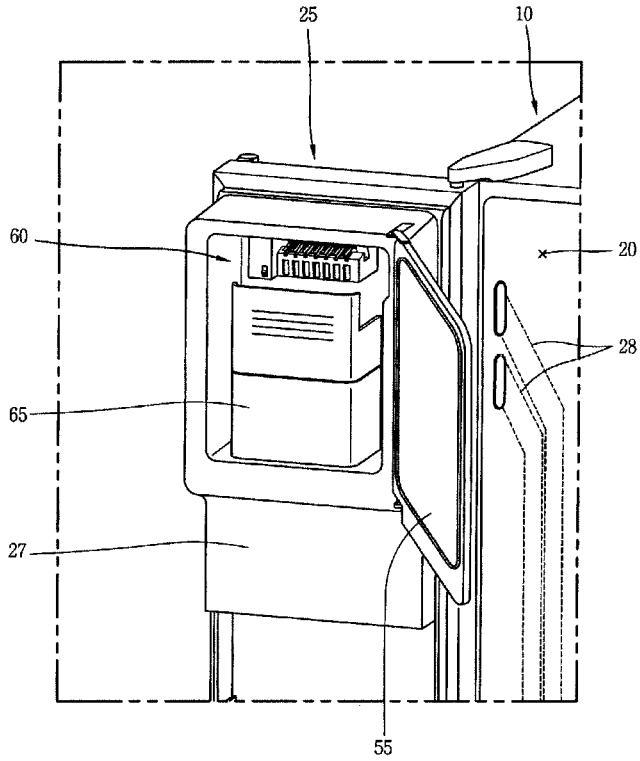
FIG. 2 RELATED ART
FIG. 2 is a perspective view illustrating an opening state of an ice-making chamber door in FIG. 1.
Figure 3:
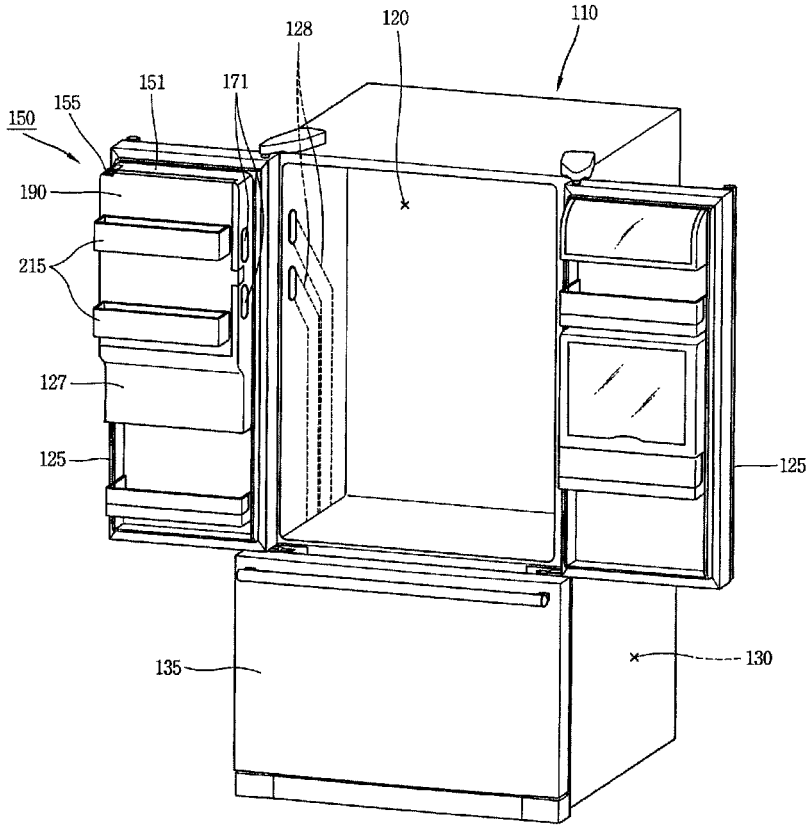
FIG. 3 is a perspective view illustrating a refrigerator having an ice-making chamber according to an embodiment of the present invention.

As illustrated in FIG. 3, a refrigerator having the ice-making chamber may be configured by including a refrigerator body 110 formed with a cooling chamber, a door configured to open and close the cooling chamber, and an ice-making chamber 150 formed in the door, wherein the ice-making chamber 150 includes an ice-making chamber body 151 one side of which is opened, a connecting duct 171 provided in a first sidewall 161 of the ice-making chamber 150 to be connected to the refrigerator body 110, an ice-making chamber door 190 provided at a second sidewall 162 of the ice-making chamber 150 to open and close the ice-making chamber 150, and a protrusion portion 181 formed to be protruded at the first sidewall 161. Here, the cooling chamber is commonly referred to a refrigerating chamber 120 and a freezing chamber 130 for accommodating and cooling foods, and the refrigerator body 110 may be configured to have the refrigerating chamber 120 and refrigerating chamber 130.

The refrigerating chamber 120 may be provided at an upper region of the refrigerator body 110. A refrigerating chamber door 125 may be provided at a front surface of the refrigerator body 110 to open and close the refrigerating chamber 120. There may be provided a plurality of refrigerating chamber doors 125. The refrigerating chamber door 125 may be revolvably combined with the refrigerator body 110.

The freezing chamber 130 may be formed at a lower region of the refrigerator body 110. A freezing chamber door 135 may be provided at the freezing chamber 130 to open and close the freezing chamber 130. The freezing chamber door 135 may be slidably provided at the refrigerator body 110 to be slid forward and backward.

A freezing cycle may be provided in the refrigerator body 110 to provide cool air to the freezing chamber 130 and refrigerating chamber 120. The freezing cycle may include a compressor for compressing refrigerant, a condenser for heat radiating refrigerant, an expansion apparatus for decompressing and expanding refrigerant, and an evaporator for allowing refrigerant to absorb and evaporate surrounding latent heat.

On the other hand, a dispenser may be provided at the refrigerating chamber door 125 to take out water or ice without opening the refrigerating chamber 120.

Figure 4:
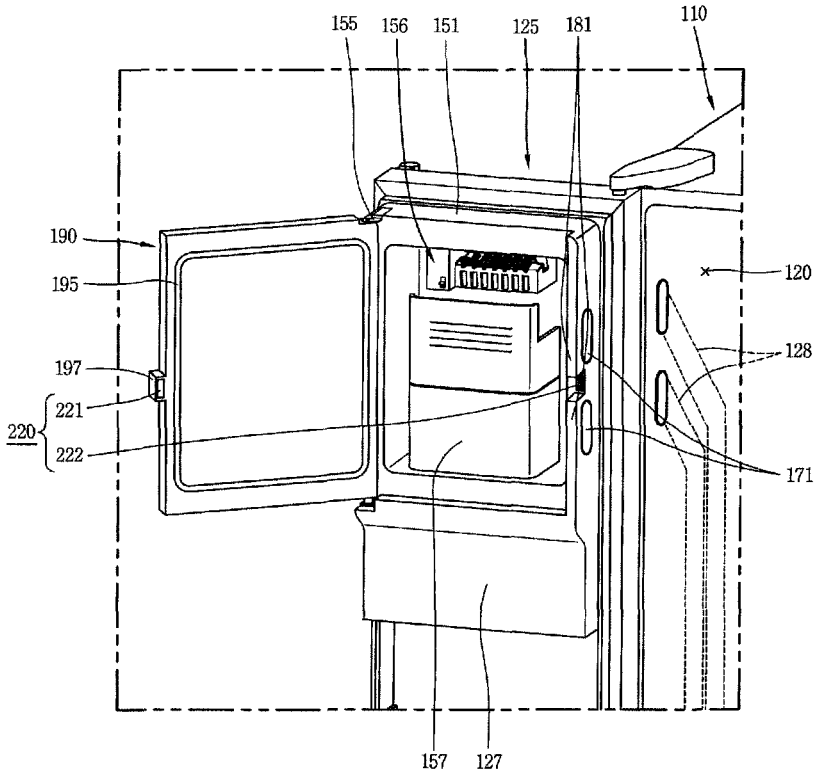
FIGS. 4 and 5 are enlarged views illustrating an ice-making chamber in FIG. 3, respectively.
Figure 5:
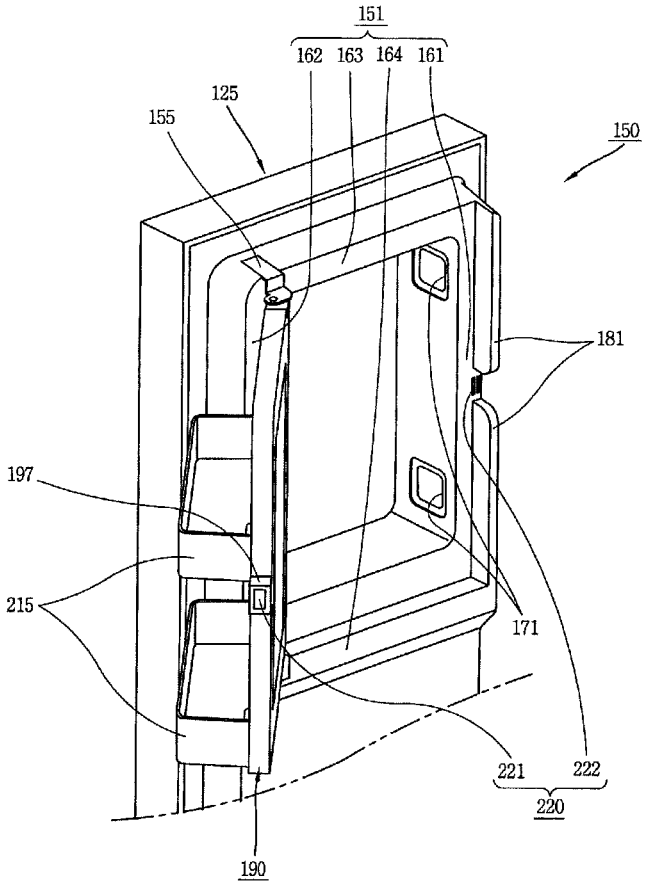

As illustrated in FIGS. 4 and 5, an ice-making chamber 150 partitioned from the refrigerating chamber 120 may be formed at an upper side of the dispenser to make ice. A connecting duct 171 connected to the refrigerator body 110 may be provided at a side of the ice-making chamber 150 to supply cool air to the ice-making chamber 150. To cope with this, a sidewall cool air duct 128 may be provided at the refrigerator body 110 to supply cool air produced in the freezing chamber 130 to the ice making chamber 150. The sidewall cool air duct 128 may be formed inside a sidewall of the refrigerator body 110. It may be formed with a pair of sidewall cool air ducts 128. One of the sidewall cool air ducts 128 may be a cool air supply channel in which the cool air of the freezing chamber 130 is supplied to the ice making chamber 150, and the other one may be a cool air return channel in which the cool air that has passed through the ice making chamber 150 is returned to the freezing chamber 130.

An ice maker 156 for making ice may be accommodated and provided inside the ice-making chamber 150. An ice bank 157 may be provided at a lower side of the ice maker 156 to accommodate the ice that has been made in the ice maker 156. The ice bank 157 may be connected to the dispenser to take out the stored ice to the outside.

The ice-making chamber 150 may include an ice-making chamber body 151 formed with an accommodating space therein, and an ice-making chamber door 190 for opening and closing the ice-making chamber body 151. The ice-making chamber body 151 may be configured to be opened rearward.

The ice-making chamber body 151 may by configured by including a first sidewall 161 and a second sidewall 162 disposed in a vertical direction of the refrigerating chamber door 125, and an upper sidewall 163 and a lower sidewall 164 disposed to be connected to the upper and lower ends of the first sidewall 161 and second sidewall 162, respectively. Here, the first sidewall 161 may be a sidewall in proximity to the sidewall of the refrigerator body 110 when the refrigerating chamber door 125 is blocked. The ice-making chamber body 151 may be formed with a single body when fabricating the refrigerating chamber door 125. An insulating material foamed by filling foaming solution when foaming the refrigerating chamber door 125 may be provided inside the ice-making chamber body 151.

A connecting duct 171 may be provided in the first sidewall 161 to be connected to the sidewall cool air duct 128. The connecting ducts 171 may be disposed to be vertically separated from each other.

An ice-making chamber door 190 may be revolvably combined with the second sidewall 162. The upper and lower ends of a side (the left side in the drawing) of the ice-making chamber door 190 may be revolvably supported by a hinge portion 155 combined with the second sidewall 162.

The ice-making chamber door 190 may be configured to have a height and width for blocking a rear side opening of the ice-making chamber 150. The ice-making chamber door 190 may be configured by including an outer plate 191, and an inner plate 192 disposed to be separated from the outer plate 191, and an insulating material 193 provided between the outer plate 191 and inner plate 192. Here, the insulating material 193 may be configured with the foam of a foaming solution by filling the foam solution between the outer plate 191 and inner plate 192.

Figure 6:
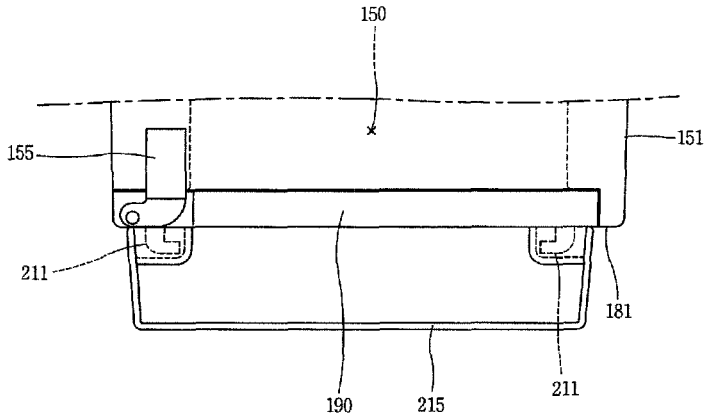
FIG. 6 is a plan view illustrating a closed state of an ice-making chamber door in FIG. 3.
Figure 7:
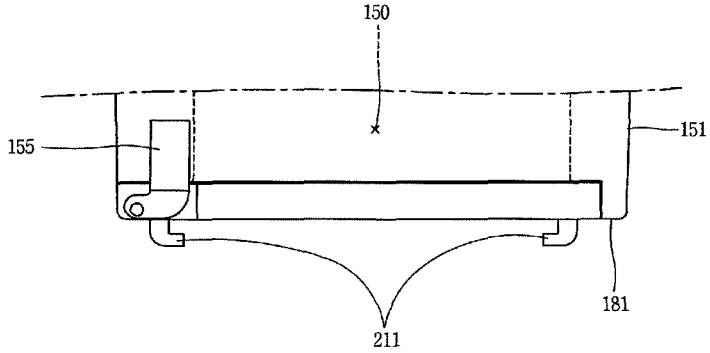
FIG. 7 is a view illustrating a detached state of an ice-making chamber door pocket in FIG. 6.

The ice-making chamber door 190, as illustrated in FIGS. 6 and 7, may be provided with an ice-making chamber door pocket 215 to accommodate foods. The ice-making chamber door pocket 215 may be configured in a detachably manner. An ice-making chamber door pocket supporting portion 211 for detachably supporting the ice-making chamber door pocket 215 may be formed at an outer surface of the ice-making chamber door 190. The ice-making chamber door pocket supporting portion 211 may be formed in an "L" shape.

On the other hand, the ice-making chamber door 190 may be formed to have a height corresponding to the upper sidewall 163 and lower sidewall 164 and a more reduced width than the length between the first sidewall 161 and an outer surface of the second sidewall 162. More specifically, the ice-making chamber door 190 may be configured to have a height corresponding to the length between a bottom surface of the lower sidewall 164 and a top surface of the upper sidewall 163 as well as a width corresponding to that between the inner and outer surfaces of the first sidewall 161 on an outer surface of the first sidewall 161.

An ice-making chamber door gasket 195 may be provided at an inner surface of the ice-making chamber door 190 to be brought into contact with a circumference of the opening of the ice-making chamber body 151 to suppress the leakage of cool air of the ice-making chamber 150. The ice-making chamber door gasket 195 may be formed to have a substantially rectangular ring shape. More specifically, the ice-making chamber door gasket 195 may be configured to be brought into contact with the upper sidewall 163, the lower sidewall 164, the first sidewall 161, and the second sidewall 162. The ice-making chamber door gasket 195 may be configured with an elastic member. By this, the ice-making chamber door gasket 195 may be elastically brought into contact with the ice-making chamber body 151, thereby effectively preventing the leakage of cool air.

On the other hand, a protrusion portion 181 protruded with a predetermined length from an end of the first sidewall 161 may be provided at the first sidewall 161 to be disposed at a side of the ice-making chamber door 190.

Figure 8:
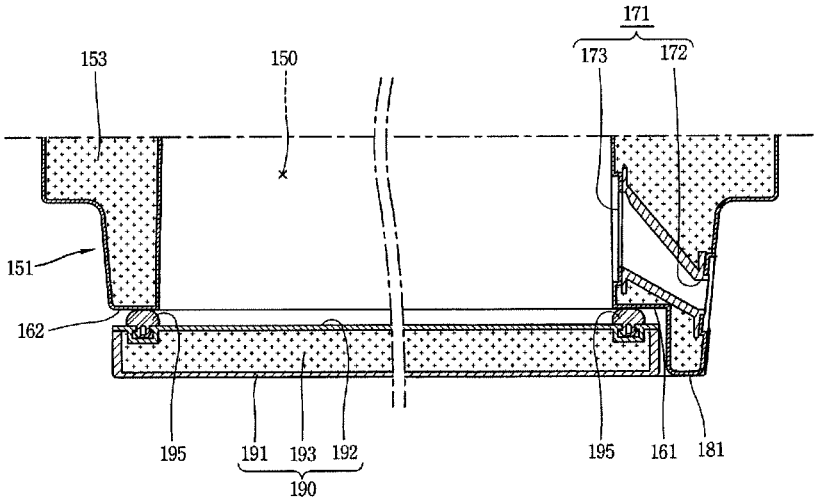
FIG. 8 is a plan cross-sectional view of FIG. 7.

The protrusion portion 181, as illustrated in FIG. 8, may be configured in such a manner that an end of the protrusion portion 181 is disposed on the same plane as an outer surface of the ice-making chamber door 190. By this, a step may be prevented from being created between the ice-making chamber door 190 and the protrusion portion 181 when blocking the ice-making chamber door 190.

A region of the connecting duct 171 may be disposed inside the protrusion portion 181.

The connecting duct 171 may be disposed in an inclined manner. More specifically, the connecting duct 171 may be disposed in such a manner that an outer side end thereof being brought into contact with the sidewall cool air duct 128 is further separated from the refrigerating chamber door 125 compared to an inner side end thereof disposed inside the ice-making chamber 150.

By this, the protrusion portion 181 is formed only at a side of the first sidewall 161, i.e., a region where the connecting duct 171 is provided, without increasing the protrusion length of the ice-making chamber body 151 as a whole, thereby increasing the thickness of the ice-making chamber door 190 while the ice-making chamber door 190 is not further protruded to a side of the refrigerating chamber 120.

Figure 9:
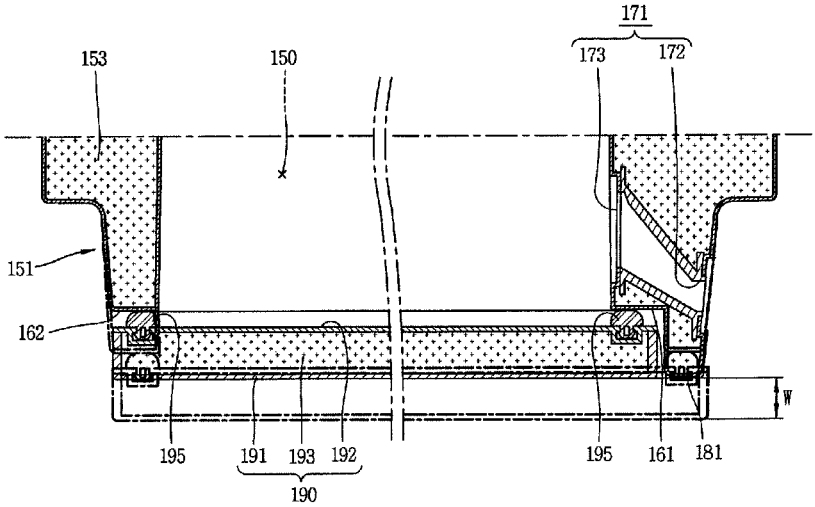
FIG. 9 is an enlarged view illustrating the main part of FIG. 8.

More specifically, as illustrated in FIG. 9, it may be seen that the ice-making chamber door 190 should be thick at an outer side (a side of the refrigerating chamber 120) to secure a sufficient thickness for the insulation of the ice-making chamber door 190 when a hinge portion of the ice-making chamber door 190 is formed at the first sidewall 161, thereby reducing the space of the refrigerating chamber 120 in the refrigerator to that extent. Here, when a hinge portion of the ice-making chamber door 190 is formed at the first sidewall 161, a protrusion portion cannot be formed at the first sidewall 161. It is because the ice-making chamber door 190 is interfered therewith and its opening (revolution) is disturbed if the protrusion portion is formed thereat. In consideration of this, when a hinge portion is formed at the first sidewall 161, the hinge portion (hinge axis) of the ice-making chamber door 190 is further protruded (moved) compared to the present invention, and the thickness of the ice-making chamber door 190 is increased only outward (to a side of the refrigerating chamber 120), thereby reducing the space of the refrigerating chamber 120 in the refrigerator to that extent (W).

On the contrary, according to the present invention, the hinge portion 155 is formed at the second sidewall 162 and the protrusion portion 181 is formed at the first sidewall 161, thereby reducing (shortening) the protrusion length of the first sidewall 161 and second sidewall 162 compared to the related art. By this, the hinge portion 155 of the ice-making chamber door 190 may be further moved to a side of the refrigerating chamber door 125. By this, the thickness of the ice-making chamber door 190 can be increased in an inward direction, i.e., to the side of the refrigerating chamber door 125. By this, the space of the refrigerating chamber 120 in the refrigerator can be increased to that extent (W).

The protrusion portions 181, as illustrated in FIG. 4, may be configured to be vertically separated from each other by a predetermined distance. An insertion portion 197 may be formed at the ice-making chamber door 190 to be inserted between the protrusion portions 181. An ice-making chamber door fixing portion 220 may be formed between the insertion portion 197 and the protrusion portion 181 to maintain a state that the ice-making chamber door 190 blocks an opening of the ice-making chamber 150.

The ice-making chamber door fixing portion 220 may be configured to maintain a combined state by a magnetic force. For example, the ice-making chamber door fixing portion 220 may be configured to have a permanent magnet 221 and a magnetic body 222. More specifically, either one of the permanent magnet 221 and magnetic body 222 may be fixed and combined with the insertion portion 197 and the other one of the permanent magnet 221 and magnetic body 222 may be combined between the protrusion portions 181. Here, the magnetic body 222 may be configured with a permanent magnet. By this, two permanent magnets having a different magnetic polarity are disposed at a region between the insertion portion 197 and protrusion portion 181, respectively, to draw to each other, thereby preventing the ice-making chamber door 190 from being accidentally opened.

Figure 10:
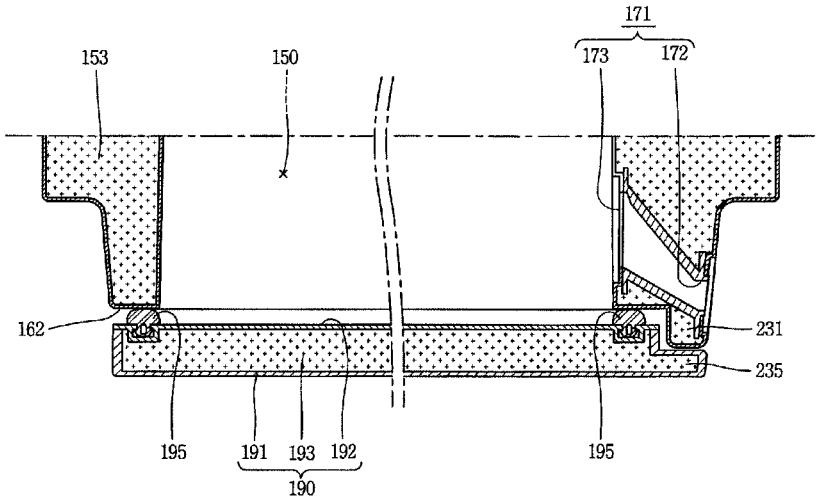
FIG. 10 is a modified example of an ice-making chamber door in FIG. 3.

On the other hand, as illustrated in FIG. 10, the protrusion portion 231 may be configured to create a step (a difference of the protrusion length) with respect to an outer surface of the ice-making chamber door 190. In other words, an end of the protrusion portion 231 may be configured to be protruded smaller than the outer surface of the ice-making chamber door 190.

The ice-making chamber door 190 may be provided with a cover portion 235 to be disposed at an outer side of the protrusion portion 231. The cover portion 235 may be configured to be reduced in a thickness direction of the ice-making chamber door 190 and extended in a width direction thereof. By this, the protrusion portion 231 may be configured to be visually blocked (hidden) by the cover portion 235 from the outside. Here, the ice-making chamber door pocket 215 may be provided at an outer surface of the ice-making chamber door 190, and the ice-making chamber door pocket 215 may be configured to be extended to the cover portion 235. By this, the accommodating space of the ice-making chamber door pocket 215 can be increased.

Figure 11:
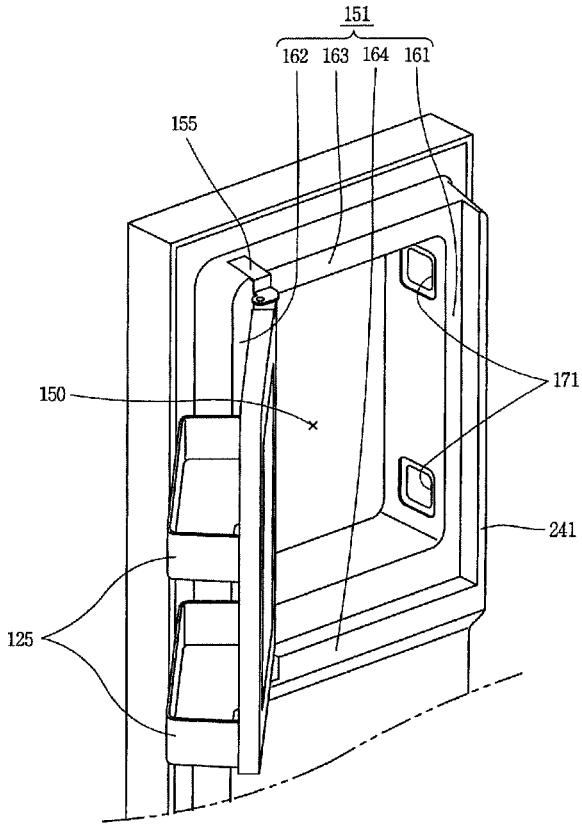
FIG. 11 is a modified example of a protrusion portion in FIG. 4.

As illustrated in FIG. 11, the protrusion portion 241 may be formed with a single body having a long length in a vertical direction. A region (outer-side end 172) of the connecting duct 171 may be disposed at an inner portion of the protrusion portion 241. Here, the protrusion level of the protrusion portion 241 may be formed in such a manner that the end thereof has the same plane as an outer surface of the ice-making chamber door 190. Also, when the cover portion 235 is formed at the ice-making chamber door 190, the protrusion portion 241 may be configured to be protruded as small as it can be disposed at an inner side of the cover portion 235.

The ice-making chamber door fixing portion 220 may be provided between the protrusion portion 231 and the cover portion 235 to suppress the ice-making chamber door 190 from being accidentally opened when closing the ice-making chamber door 190. The ice-making chamber door fixing portion 220 may be configured by including a permanent magnet 221 and a magnetic body 222 (or permanent magnet).

By such a configuration, if the refrigerating chamber door 125 is closed to block the refrigerating chamber 120, then each connecting duct 171 of the ice-making chamber 150 is communicated with the sidewall cool air duct 128. When the ice maker 156 is in an ice-making mode, cool air produced in the refrigerating chamber 130 is supplied to the ice-making chamber 150 through the sidewall cool air duct 128. The air that has been moved through the sidewall cool air duct 128 is flowed into the ice-making chamber 150 through the connecting duct 171 to cool the ice-making chamber 150. By this, ice is made in the ice maker 156. The cool air that has cooled the ice-making chamber 150 is flowed out of the ice-making chamber 150. The flowed-out cool air is moved through the other one of the sidewall cool air ducts 128 to be returned to the freezing chamber.

As described above, according to an embodiment of the present invention, a protrusion portion is formed at a first sidewall of the ice-making chamber, and an ice-making chamber door is revolvably combined with a second sidewall thereof, thereby reducing the protrusion width of the ice-making chamber protruded from an inner surface of the cooling chamber door. By this, the space of the cooling chamber in the refrigerator can be increased as much as decreasing the protrusion width of the ice-making chamber.

In addition, a connecting duct for connecting the ice-making chamber with the refrigerator body is disposed at an inner side of the protrusion portion, thereby securing the thickness of the ice-making chamber door without changing the position and size of a cool air channel of the ice-making chamber door, more specifically, a connecting duct formed in the ice-making chamber and a sidewall cool air duct formed in the refrigerator body.

As described above, specific embodiments of the present invention are illustrated and described herein with reference to the accompanying drawings. However, the present invention can be implemented in various embodiments without departing from the spirit or gist of the invention, and thus the foregoing embodiments should not be limited to the content of the detailed description.

Furthermore, the foregoing embodiments should be broadly construed within the scope of the technical spirit defined by the appended claims even though they are not specifically disclosed in the detailed description herein. Moreover, all changes and modifications within the technical scope of the claims and the equivalent scope thereof should be construed to be included in the appended claims.

What is claimed is:

1. A refrigerator having an ice-making chamber, comprising:

a refrigerator body having a refrigerating chamber and a freezing chamber;

a refrigerating chamber door configured to open and close the refrigerating chamber; and an ice-making chamber located at the refrigerating chamber door, wherein the ice-making chamber comprises:

an ice-making chamber body, one side of which is opened, the ice-making chamber having first and second sidewalls;

a connecting duct provided in the first sidewall of the ice-making chamber to be connected to a sidewall cool air duct of the refrigerator body;

an ice-making chamber door provided at one of the first and second sidewalls of the ice-making chamber to open and close the ice-making chamber; and a protrusion portion that protrudes at an end of the first sidewall, the protrusion portion protruding to a side of the refrigerating chamber further than the second sidewall protrudes to a side of the refrigerating chamber, wherein a region of the connecting duct is disposed inside the protrusion portion, wherein the connecting duct is inclined with respect to a width direction of the ice-making chamber door such that an outer side end of the connecting duct that contacts the sidewall cool air duct is separated from the refrigerating chamber door further than an inner side end of the connecting duct that is disposed inside the ice-making chamber.

2. The refrigerator having an ice-making chamber of claim 1, wherein an ice-making chamber door pocket is provided at the ice-making chamber door.

3. The refrigerator having an ice-making chamber of claim 1, wherein the ice-making chamber door is provided with an insulating material.

4. The refrigerator having an ice-making chamber of claim 3, wherein the insulating material is formed by filling foaming solution between an outer plate and an inner plate of the ice-making chamber door.

5. The refrigerator having an ice-making chamber of claim 1, wherein the ice-making chamber door is formed to be disposed at a side of the protrusion portion.

6. The refrigerator having an ice-making chamber of claim 5, wherein a plurality of protrusion portions are provided therein, and vertically disposed to be separated from one another.

7. The refrigerator having an ice-making chamber of claim 6, wherein an ice-making chamber door fixing portion is provided between the protrusion portions to maintain a state of the ice-making chamber door being closed.

8. The refrigerator having an ice-making chamber of claim 5, wherein an end of the protrusion portion is disposed on the same plane as an outer surface of the ice-making chamber door.

9. The refrigerator having an ice-making chamber of claim 5, wherein the protrusion portion is formed with a single body having a long length in a vertical direction.

10. The refrigerator having an ice-making chamber of claim 9, wherein the protrusion portion forms a step from an outer surface of the ice-making chamber door.

11. The refrigerator having an ice-making chamber of claim 10, wherein the ice-making chamber door is provided with a cover portion extended to be disposed at an outer side of the protrusion portion.

12. A refrigerator having an ice-making chamber, comprising:

a refrigerator body provided with a refrigerating chamber;

a refrigerating chamber door configured to open and close the refrigerating chamber; and an ice-making chamber located at the refrigerating chamber door, wherein the ice-making chamber is provided with a first sidewall and a second sidewall disposed in parallel to each other, and a protrusion portion more protruded to a side of the refrigerating chamber than the second sidewall, the protrusion portion being located at an end of the first sidewall, and the ice-making chamber comprises:

an ice-making chamber door provided at one of the first and second sidewalls to open and close the ice-making chamber; and a connecting duct disposed inside the first sidewall to be connected to a sidewall cool air duct of the refrigerator body, wherein a region of the connecting duct is disposed inside the protrusion portion wherein the connecting duct is inclined with respect to a width direction of the ice-making chamber door such that an outer side end of the connecting duct that contacts the sidewall cool air duct is separated from the refrigerating chamber door further than an inner side end of the connecting duct that is disposed inside the ice-making chamber.

13. The refrigerator having an ice-making chamber of claim 12, wherein a freezing chamber is provided at a lower side of the refrigerating chamber, and the sidewall cool air duct is provided in the refrigerator body such that one end thereof is communicated with the freezing chamber, and the other end thereof is connected to the connecting duct.

14. A refrigerator having an ice-making chamber, comprising:

a refrigerator body provided with a refrigerating chamber at an upper portion thereof and a freezing chamber at a lower portion thereof, and provided with a sidewall cool air duct communicated with the freezing chamber at a sidewall thereof;

a refrigerating chamber door configured to open and close the refrigerating chamber; and an ice-making chamber provided in the refrigerating chamber door, wherein the ice-making chamber comprises:

an ice-making chamber body, one side of which is opened, the ice-making chamber body having a first sidewall and a second sidewall disposed in parallel to each other;

a connecting duct provided in the first sidewall of the ice-making chamber to be connected to the sidewall cool air duct;

an ice-making chamber door provided at one of the first and second sidewalls of the ice-making chamber to open and close the ice-making chamber; and a protrusion portion that protrudes to a side of the refrigerating chamber further than the second sidewall, the protrusion portion being disposed at an end of the first sidewall, wherein a region of the connecting duct is disposed inside the protrusion portion, wherein the connecting duct is inclined with respect to a width direction of the ice-making chamber door such that an outer side end of the connecting duct that contacts the sidewall cool air duct is separated from the refrigerating chamber door further than an inner side end of the connecting duct that is disposed inside the ice-making chamber.

* * * * *